United States Patent [19]

Buckwalter

[11] Patent Number: 5,007,189

[45] Date of Patent: Apr. 16, 1991

[54] SEAL FOR ART DISPLAY FRAMES OF WOOD

[76] Inventor: Kendrick Buckwalter, 18 Chetwynd Rd., Paoli, Pa. 19301

[21] Appl. No.: 169,278

[22] Filed: Mar. 17, 1988

[51] Int. Cl.[5] ..... A47G 1/06

[52] U.S. Cl. ..... 40/152

[58] Field of Search ..... 40/152, 152.1, 209, 40/158.1, 578

[56] References Cited

U.S. PATENT DOCUMENTS

| | | | |
|---|---|---|---|
| 769,867 | 9/1904 | Main | 40/152 |
| 881,073 | 3/1908 | Hewitt | 40/152 |
| 1,048,343 | 12/1912 | Rice | 40/152 |
| 1,634,921 | 7/1927 | Straus | 40/152 |
| 2,130,090 | 9/1938 | Imhofe | 40/578 |
| 2,173,134 | 9/1939 | Vokaty | 40/209 |
| 2,190,557 | 2/1940 | Connell | 40/152 |
| 2,654,451 | 10/1953 | Schmidgall | 40/152 |
| 3,771,245 | 11/1973 | Mabrey et al. | 40/578 |
| 4,183,160 | 1/1980 | Brodersen | 40/152 |

*Primary Examiner*—Gene Mancene
*Assistant Examiner*—Michael Lynch
*Attorney, Agent, or Firm*—William E. Cleaver

[57] ABSTRACT

The present device, in a preferred embodiment, is a flexible plastic strip which is formed to be substantially in the shape of the letter L. The flexible plastic strip is shaped so that it can sit on the rabbet of a frame which displays art, such as a picture frame. The plastic strip is secured to the inside wall and the ledge of the wooden frame so that moisture and/or tiny life forms, such as tiny insects or larvae, which normally reside in the wooden frame cannot penetrate the seal and do damage to the art work. The plastic strip is flexible so that it can be cut and used with any shape of wooden frame such as an oval shaped frame, a rectangularly shaped frame, or the like.

1 Claim, 1 Drawing Sheet

SEAL FOR ART DISPLAY FRAMES OF WOOD

BACKGROUND OF THE INVENTION

It is well understood by the general public as well as those skilled in the art of framing, that wooden frames used to display pictures, or crewel work, or dried flowers, and the like, are the most popular types of frames. It is also well understood by those skilled in the art of picture framing, that wooden frames contain residual acids and/or tiny life forms, such as tiny insects or larvae. In the prior art the residual acids have emanated from the wooden frames and have entered into the air, in the chamber, between the art work and the glass piece through which the art work is viewed. Such acidic vapors have acted to cause the art work to turn brown and ultimately to disintegrate. Some attempts have been made to overcome the (residual) acidic vapor problem. One such attempt has been to "dry out" the wooden frames but such a technique has been costly and unsatisfactory from the standpoint that the wooden frames have lost their natural appeal due to the drying out process. A second attempt has been employed which involves making the display frames from metals such as aluminum, which of course have no residual acid. With respect to the problem of resident tiny life forms, an attempted solution has been to fumigate the wood so as to kill either the insects or the larvae. Again, such a procedure is costly and in fact it has not always been effective because in some cases even after fumigation tiny life forms have appeared.

The present invention permits the person doing the framing to employ wood in its natural form, (i.e. without either fumigating or drying out the moisture) while yet preventing harm to the art work by sealing the art work against permeation by liquids, gases, and/or vapors as well as permeation by the tiny life forms found resident in the wooden frames.

SUMMARY OF THE DISCLOSURE

In accordance with the preferred embodiment of the present device, a strip of acrylic material is formed to substantially resemble the letter "L". The strip of acrylic is flexible so that it can be bent and shaped into many configurations and therefore can be used with rectangularly shaped frames, oval shaped frames, circular frames and the like. The "L" shaped strip is employed in an "L" shape form so that the base or short extension of the "L" shaped strip sits in abutment with the ledge, or rabbet, of the wooden frame. In addition, the elongated section of the "L" shaped strip is in abutment with the inside wall of the wooden frame. The "L" shaped strip is secured to the ledge and the inside wall by an adhesive material, preferably a pressure sensitive adhesive. Since the strip is fabricated from a material which is impervious to liquids, gases or vapors, no liquids, gases or vapors emanating from the inside walls or the ledge can pass through the "L" shaped strip into the air chamber between the art work and the viewing glass or viewing piece. Accordingly there is no damage to the art work because of the presence of damaging liquids, gases, or vapors. It is also true that because the "L" shaped strip is fabricated of material that does not permit any tiny life forms to pass through, the art work is not damaged by tiny life form activity.

The features and objects of the present invention will be better understood when the following description is studied in accordance with the drawings wherein.

Figure 1:
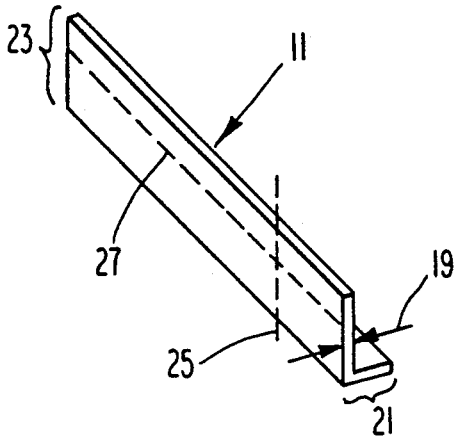
FIG. 1 shows an exaggerated pictorial view of the "L" shaped strip.
Figure 2:
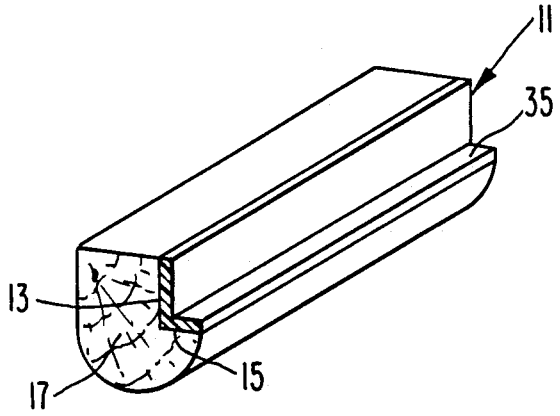
FIG. 2 shows a sectional view of a piece of a wooden frame which has been sealed by the "L" shaped strip.

Consider FIG. 1. In FIG. 1 there is shown an "L" shaped sealing strip which provides the seal between the inside wall and the ledge of a wooden frame and the art work which that wooden frame is employed to display. Wooden frames traditionally have been made of basswood, oak, pine, ramin wood, poplar, mahogany, and maple although other forms of wood have been used. Wooden frames made of such woods have a residual acidic content therein and such residual acid emanates over a period of time from such woods to enter into the air which is trapped between the viewing piece, such as the glass piece, and the art work which is to be shown. Such wooden frames have traditionally had a inside wall 13 as shown in FIG. 2 and a ledge or rabbet, 15 as shown in FIG. 2. The viewing piece, usually glass, normally comes to rest on the ledge 15. Separating the viewing piece from the art work has traditionally been accomplished by employing a mat. In more recent times, a device called "INNERSPACE" (which is a registered trademark of the present inventor) has been used to provide a separation device between the viewing piece or glass piece, and the piece of art. In any event, whatever may be used to separate the viewing piece from the piece of art causes a chamber of air to exist between the viewing piece and the art work per se. Very often it has been the case that the piece of wood, such as wood 17 in FIG. 2, has contained residual acid and/or tiny life forms such as insects or larvae. When the art work has been mounted within the wooden frame, in the prior art, the residual acids have emanated from the wood such as the wooden frame 17 in the form of liquids, or gasses, or vapors and/or the tiny life forms have migrated to the air chamber. Those acidic forms have served to brown or burn out the art work and the tiny life forms have done damage and of course that is a very undesirable situation. In accordance with the present invention, the acrylic strip 11, shown in FIG. 1 and in FIG. 2, is employed to seal off the wooden frame from the chamber created between the viewing piece and the art work as well as directly from the art work itself. In the preferred embodiment the thickness 19 of the "L" shaped strip is 20 mils, however other thicknesses could be employed. The "L" shaped strip 11 is made into an "L" shape so that the base 21 can come to rest against the ledge 15 while the elongated section 23 can come to rest on the side wall 13. Now it should be understood that the 20 mil "L" shaped strip can be cut along such lines as the dashed line 25 to shorten the length of the acrylic strip 11 if a shortened length should be so desired. In addition the acrylic strip 11 can be cut along the dashed line 27 if indeed the side wall of the wooden frame is shorter than the standard length of the elongated section 23. In the preferred embodiment the length 23 is 5/8ths of an inch while the width of the base section 21 is 3/16 of an inch. Obviously other lengths of the elongated section and widths of the base section could be employed.

FIG. 2 shows the "L" shaped strip resting on the rabbet or the ledge 15 and being in abutment with inner wall 13. The "L" shaped acrylic strip is secured to the inner wall and to the ledge 15 by adhesive and in the preferred embodiment that adhesive is a pressure sensitive adhesive such as 3M Type 465 adhesive, so that the picture framer can relocate the "L" strip if in fact when it is first positioned it is not in the proper position. It should be understood that the "L" shaped strip 11 could be secured to the side wall and to the ledge by some more permanent adhesive if so desired.

The "L" shaped strip is fabricated from acrylic material in the preferred embodiment although other forms of plastic or ceramic material could be employed provided such materials are impervious to liquids, gases and vapors and are impervious to tiny life forms such as insects and larvae. In the preferred embodiment I have employed acrylic because of its great flexibility and the fact that it can be recut into various sizes to accommodate different frame configurations.

Figure 3:
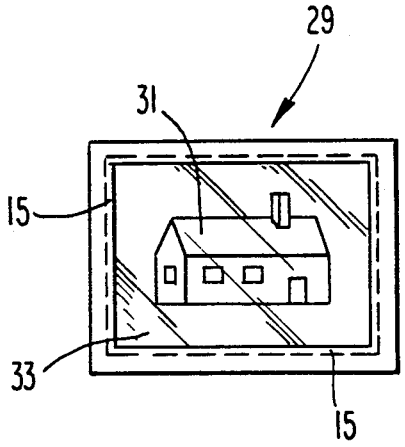
FIG. 3 depicts a rectangularly shaped frame employing the "L" shaped strip.

FIG. 3 depicts a rectangular frame 29 displaying a house 31 as art work. The dashed line shown around the rectangular frame 29 is shown to depict that there is a ledge 15 and that the ledge 15 is holding the base 21 of the "L" shaped strip away from the viewer of FIG. 3. The viewing piece 33 which is likely to be a piece of glass, or clear plastic, is resting upon the base 21, actually upon the surface 35 shown in FIG. 2. Separating the viewing piece 33 from the art work 31 is accomplished by INNERSPACE separators or a mat of some kind.

Figure 4:
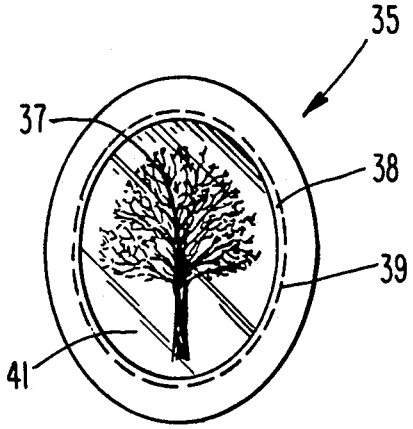
FIG. 4 depicts an oval shaped wooden frame employing the "L" shaped strip.

FIG. 4 depicts an oval shaped frame 35 which is displaying the art work (i.e. art work 37). Similarly to that which was discussed in connection with FIG. 3, the ledge 38 is depicted to lie within the dashed line 39. Resting on the ledge 38 is a base section 21 of the "L" shaped strip which has been formed into an oval shape. It should be understood that the "L" shaped strip could be made up of a number of sections of "L" shaped strips to completely seal the rabbet and inside wall of any particular frame. In FIG. 4 the viewing piece 41 is resting on the surface (which is similar to the surface 35 in FIG. 2) of the "L" shaped strip. Lying between the viewing piece 41 and the art work 37 could be some INNERSPACE separators to hold the art work away from the viewing piece 41. The "L" shaped strip is fitted into the oval shaped frame 35 in a fashion similar to the way the "L" shaped strip is fitted into the frame piece 17. The "L" shaped strip serves to keep the destructive acidic vapors or tiny life forms from entering the space defined by the INNERSPACE separators.

Figure 5:
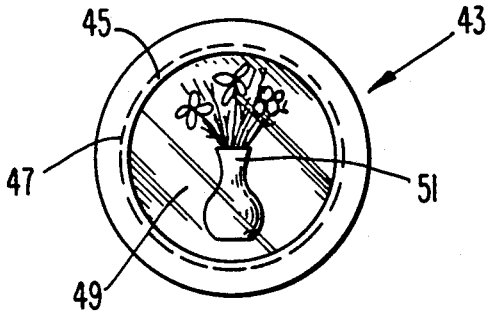
FIG. 5 depicts a circularly shaped frame employing the "L" shaped strip.

FIG. 5 depicts a circular frame 43 whose ledge 45 is defined by the dashed line 47. Mounted on the ledge 45 and on the inner wall of the frame 43 is an "L" shaped strip which has been formed into a circle. The "L" shaped strip is secured to both the ledge 45 and the inside wall of the frame 43. As was mentioned earlier the "L" shaped strip can be a plurality of "L" shaped strips which fit together to seal off the inside wall and the ledge of the circular frame 43. In the circular frame of FIG. 5, the viewing piece 49 is separated from the art work 51 by INNERSPACE separators or by a mat and again the chamber defined by the INNERSPACE separators is held free of acidic contamination or contamination by tiny life forms by the "L" shaped sealing device.

The "L" shaped sealing device 11 can be either in integral form, that is having the base section integral with the elongated section 23 or can be formed of two pieces by having the base section 21 represent one piece and the elongated section 23 representing a second piece. By having the "L" shaped strip formed integrally, into an "L" shape it enables the framer to more readily place the strip into position on the ledge and the inside wall. However, it should be understood that, in the discussion herein and in the claims, a reference to an "L" shaped strip means that it could be two pieces, or one piece, or many pieces, to provide a sealing effect by the material secured to both the ledge 15 and the inner wall 13 as depicted in FIG. 2.

I claim:

1. A wooden picture frame, having a rabbet configuration, as part thereof, which is sealed against the passage of liquids, gasses, vapors and tiny life forms emanating from said rabbet configuration comprising in combination: a wooden frame including an inside wall section and a ledge section protruding therefrom whereby said inside wall section and said ledge section together substantially form the shape of the letter "L"; sealing means formed substantially in the shape of the letter "L", having a base section and an elongated section extending from said base section; said sealing means formed and disposed so that said base section is in abutment with said ledge section and of substantially the same width and length of said ledge section and said sealing means further formed and disposed so that said elongated section is in abutment with said inside wall section and of substantially the same width and length of said inside wall section; said sealing means formed of material which is impervious to the passage of liquids, gases, vapors and tiny life forms.

* * * * *